US006247621B1

(12) United States Patent
Lewis

(10) Patent No.: US 6,247,621 B1
(45) Date of Patent: Jun. 19, 2001

(54) DUAL USE DISPENSING SYSTEM

(75) Inventor: Richard Paul Lewis, Marietta, GA (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 09/356,265

(22) Filed: Jul. 16, 1999

Related U.S. Application Data

(60) Provisional application No. 60/102,455, filed on Sep. 30, 1998.

(51) Int. Cl.[7] ..... B65D 88/54

(52) U.S. Cl. ..... 222/321.8; 222/153.13; 222/183; 222/385

(58) Field of Search ..... 222/95, 105, 153.13, 222/181.1, 181.2, 181.3, 185, 185.1, 321.8, 321.9, 385, 538

(56) References Cited

U.S. PATENT DOCUMENTS

| | | | |
|---|---|---|---|
| D. 246,338 | 11/1977 | Jespersen | D6/95 |
| D. 253,441 | 11/1979 | Tucker | D6/95 |
| D. 268,154 | 3/1983 | Frassanito | D6/95 |
| D. 299,399 | 1/1989 | Lippman | D6/545 |
| D. 312,184 | 11/1990 | De Luca et al. | D6/545 |
| D. 321,453 | 11/1991 | Ophardt | D7/300 |
| D. 332,544 | 1/1993 | Steiner et al. | D6/545 |
| D. 342,176 | 12/1993 | Steiner et al. | D6/545 |
| D. 345,664 | 4/1994 | Brandenburg | D6/545 |
| D. 345,877 | 4/1994 | Brandenburg | D6/545 |
| D. 349,827 | 8/1994 | Brandenburg | D6/545 |
| D. 350,665 | 9/1994 | Ophardt | D6/545 |
| D. 359,408 | 6/1995 | Frassanito | D6/545 |
| D. 378,035 | 2/1997 | Ophardt | D6/545 |
| D. 379,728 | 6/1997 | Simon | D6/545 |
| D. 383,631 | 9/1997 | Wirt et al. | D6/545 |
| D. 386,640 | 11/1997 | Wirt et al. | D6/545 |
| D. 388,990 | 1/1998 | Brandenburg et al. | D6/545 |

(List continued on next page.)

FOREIGN PATENT DOCUMENTS

| | | | |
|---|---|---|---|
| 0530789B1 | 6/1995 | (EP) | A47K/5/122 |
| 2 653 100 | 4/1991 | (FR) . | |
| 97/16107 | 5/1997 | (WO) . | |
| 98/09732 | 3/1998 | (WO) . | |

OTHER PUBLICATIONS

Copy of PCT International Search Report of Jan. 21, 2000.

*Primary Examiner*—Philippe Derakshani
*Assistant Examiner*—Thach H. Bui
(74) *Attorney, Agent, or Firm*—Scott B. Garrison

(57) ABSTRACT

A fluid dispensing system is disclosed herein, the system including a container adapted to hold a material, the container having a first recess positioned on an outer surface of the container and a passageway extending into the container, the passageway positioned within the recess of the container. A pump assembly is provided which is adapted to dispense fluid from the container. The pump assembly is further adapted to engage the passageway of the container and having a storage position wherein the pump assembly is disposed substantially within the recess. In selected embodiments, a mounting bracket is provided which is adapted to support the container. The mounting bracket may include a base, a column extending upwardly from the base, and an upper member which may be pivotably mounted to the column. In some embodiments, a boss and detent may be provided so that the boss engages the detent upon placement of the container within the mounting bracket. The boss and detent are adapted to inhibit relative movement between the mounting bracket and container. A pump actuator may be provided, the pump actuator including an upper portion flexibly attached to a lower portion, the lower portion operable to actuate the pump assembly and dispense fluid from the container.

11 Claims, 13 Drawing Sheets

U.S. PATENT DOCUMENTS

| | | | | |
|---|---|---|---|---|
| D. 391,431 | | 3/1998 | Brandenburg et al. | D6/545 |
| D. 395,774 | | 7/1998 | Phillips et al. | D6/545 |
| D. 414,363 | | 9/1999 | Daansen | D6/545 |
| 2,545,988 | | 3/1951 | Bobrick | 222/341 |
| 3,721,370 | | 3/1973 | Blum | 222/385 |
| 4,018,363 | | 4/1977 | Cassia | 222/80 |
| 4,036,406 | | 7/1977 | Jespersen et al. | 222/181 |
| 4,142,651 | | 3/1979 | Leopoldi et al. | 222/185 |
| 4,159,788 | | 7/1979 | Doyel | 222/144.5 |
| 4,164,306 | | 8/1979 | Perrin | 222/181 |
| 4,236,655 | | 12/1980 | Humphries | 222/465 |
| 4,248,398 | | 2/1981 | Doyel | 248/220.1 |
| 4,349,133 | | 9/1982 | Christine | 222/183 |
| 4,394,938 | | 7/1983 | Frassanito | 222/207 |
| 4,421,254 | | 12/1983 | Spector | 222/180 |
| 4,470,523 | | 9/1984 | Spector | 222/181 |
| 4,493,440 | | 1/1985 | Von Buelow et al. | 222/109 |
| 4,546,904 | | 10/1985 | Frassanito | 222/185 |
| 4,573,612 | | 3/1986 | Maddison et al. | 222/94 |
| 4,621,749 | | 11/1986 | Kanfer | 222/153 |
| 4,650,095 | | 3/1987 | Tella et al. | 222/153 |
| 4,662,195 | | 5/1987 | Von Buelow et al. | 70/139 |
| 4,673,109 | | 6/1987 | Cassia | 222/153 |
| 4,679,709 | | 7/1987 | Poitras et al. | 222/180 |
| 4,805,814 | | 2/1989 | Allen, Sr. | 222/538 |
| 4,811,870 | | 3/1989 | Bianco | 222/461 |
| 4,834,269 | | 5/1989 | Cone | 222/465.1 |
| 4,886,192 | | 12/1989 | Cassia | 222/181 |
| 4,895,276 | | 1/1990 | Maldonado | 222/144.5 |
| 4,964,544 | | 10/1990 | Hanna et al. | 222/181 |
| 4,972,973 | * | 11/1990 | Davis | 222/538 |
| 4,974,753 | | 12/1990 | Tucker et al. | 222/181 |
| 5,042,691 | | 8/1991 | Maldonado | 222/144.5 |
| 5,131,568 | | 7/1992 | Ringuette | 222/143 |
| 5,165,577 | | 11/1992 | Ophardt | 222/181 |
| 5,174,476 | | 12/1992 | Steiner et al. | 222/181 |
| 5,183,182 | | 2/1993 | Comstock et al. | 222/129 |
| 5,209,377 | | 5/1993 | Steiner et al. | 222/189 |
| 5,226,625 | | 7/1993 | Hanna | 248/222.1 |
| 5,261,557 | | 11/1993 | Bytell et al. | 220/662 |
| 5,265,772 | | 11/1993 | Bartasevich et al. | 222/214 |
| 5,282,552 | | 2/1994 | Ophardt | 222/181 |
| 5,373,970 | | 12/1994 | Ophardt | 222/181 |
| 5,413,251 | | 5/1995 | Adamson | 222/129 |
| 5,421,489 | | 6/1995 | Holzner, Sr. et al. | 222/207 |
| 5,431,309 | | 7/1995 | Ophardt | 222/181.3 |
| 5,443,236 | | 8/1995 | Bell et al. | 248/311.3 |
| 5,452,825 | | 9/1995 | Comstock et al. | 222/135 |
| 5,464,125 | | 11/1995 | Daansen | 222/156 |
| 5,489,044 | | 2/1996 | Ophardt | 222/1 |
| 5,501,272 | | 3/1996 | Daansen | 222/207 |
| 5,501,372 | | 3/1996 | Daansen | 222/207 |
| 5,556,005 | | 9/1996 | Banks | 222/96 |
| 5,595,324 | | 1/1997 | Brown et al. | 222/1 |
| 5,597,097 | | 1/1997 | Morris | 222/529 |
| 5,598,952 | | 2/1997 | Daansen | 222/105 |
| 5,605,256 | | 2/1997 | Fan | 222/181.2 |
| 5,632,418 | | 5/1997 | Brown | 222/180 |
| 5,638,989 | | 6/1997 | Ophardt et al. | 222/105 |
| 5,649,643 | | 7/1997 | Ridgeway | 222/105 |
| 5,676,277 | | 10/1997 | Ophardt et al. | 222/83 |
| 5,725,131 | | 3/1998 | Bell et al. | 222/196 |
| 5,799,826 | | 9/1998 | Brown et al. | 222/4 |
| 5,826,755 | | 10/1998 | Burd | 222/309 |
| 5,860,574 | * | 1/1999 | Shanklin et al. | 222/383.3 |
| 5,862,956 | | 1/1999 | Brandenburg et al. | 222/214 |
| 5,865,352 | | 2/1999 | Leary | 222/517 |
| 5,897,031 | | 4/1999 | Wirt et al. | 222/179 |
| 5,944,227 | | 8/1999 | Schroeder et al. | 222/144.5 |
| 5,975,360 | | 11/1999 | Ophardt | 222/83 |
| 6,076,707 | * | 6/2000 | Feldner | 222/181.1 |

* cited by examiner

DUAL USE DISPENSING SYSTEM

This application claims the benefit of U.S. Provisional Application No. 60/102,455 filed Sep. 30, 1998, the entirety of which is hereby incorporated by reference.

FIELD OF THE INVENTION

The present invention relates generally to dispensing systems, and more particularly to dispensing systems having a dual use container.

BACKGROUND

Dispensing systems for flowable cleaning products such as soaps and the like are commonly used in institutional and industrial locations to dispense single-use portions of the cleaning product to a user. Such dispensing systems may include a dispenser which may be mounted to a wall or other surface. A bag or other suitable reservoir containing the cleaning product is typically enclosed within the dispenser, out of view of the user. A pump is typically inserted into the bag or reservoir. The reservoir and pump are then enclosed within a dispenser so that the pump may be activated from exteriorly of the dispenser. Upon application of pressure to a dispensing arm or other similar member, the pump is actuated to dispense a singleuse portion of the material from the dispensing system.

An example of such a dispensing system is disclosed in U.S. Pat. No. 5,165,577 to Ophardt. The dispensing system disclosed therein includes a disposable plastic element which includes a disposable liquid reservoir and a disposable pump assembly. The disposable liquid reservoir and disposable pump assembly are each formed entirely out of recyclable plastic. The dispensing system also includes a permanent non-disposable housing for the reservoir and pump assembly including a permanent actuating system to operate the pump assembly. As shown therein, the disposable liquid reservoir is hidden within the permanent non-disposable housing.

While a variety of dispensing systems are currently available, there remains a need for a more convenient and economical dispensing system which simplifies and reduces the maintenance required. The system can clearly display the level of product remaining within the dispensing system. Additionally, selected embodiments of the present invention reduce the cleaning efforts required by support personnel by reducing the dispenser area that needs to be cleaned during replacement of the cleaning product. Because, in selected embodiments, the container is replaced rather than refilled as conventional dispensers are, the only item which is reused is the bracket. Thus, the bracket alone needs to be cleaned. Additionally, it is desirable that the components of a dispensing system may be both inexpensive and easily utilized with other dispensing systems. Such a dispensing system may also be compactly shipped and stored.

SUMMARY OF THE INVENTION

The present invention is directed to a dispensing system which includes a container having a first recess positioned on an outer surface of the container and a passageway extending into the container, the passageway positioned within the recess of the container. The container may be utilized with a mounting bracket such as, for example, the mounting bracket described herein, or may be utilized as a refill which fits within a conventional dispenser which substantially encloses the refill.

Selected embodiments of the present invention further include a mounting bracket adapted to support the container. The mounting bracket, in particular embodiments, also includes a base and a column extending upwardly from the base.

The mounting bracket and container may be adapted to engage each other in a manner which inhibits relative movement between the mounting bracket and the container. To accomplish this, the mounting bracket may include a protruding member such as a boss or key which engages an indentation in the container such as a detent or slot. Alternately, the protruding member may be positioned on the container while the indentation is formed in the mounting bracket.

The mounting bracket may further include an upper member which may extend outwardly from the column. An end of the upper member may be pivotably or rotatably attached to the column so that the upper member may move away from the column and base to permit the container to be placed within the mounting bracket. Once the container is placed within the mounting bracket, the upper member may be moved toward the container to assist in retaining the container within the bracket. In other embodiments, the upper member, column and base of the mounting bracket may be formed as a single piece such as, for example, a C-shaped bracket. The base and upper member may flex outwardly with respect to the column to permit the container to be inserted into and engage the mounting bracket.

In selected embodiments of the dispensing system, the container may further include a second recess which may be positioned on an exterior surface of the container such as, for example, the upper surface of the container. The upper member may be disposed within the second recess so that the dispensing system may have a more compact configuration.

Selected embodiments may also include a locking mechanism which permits the container to be locked to the mounting bracket. Locking mechanisms such as, for example, latch and post mechanisms and the like are suitable for use with the present invention.

The dispensing system of the present invention may further including a pump assembly adapted to engage the passageway of the container, the pump assembly having a storage position wherein the pump assembly is substantially disposed within the first recess. The container and pump assembly may be utilized with a mounting bracket such as, for example, the mounting bracket described herein, or may be utilized as a refill which fits within a conventional dispenser.

Particular embodiments of the dispensing system of the present invention may also include a pump actuator which is operable to actuate a pump assembly and dispense material from the container. The pump actuator may further including a lower portion and an upper portion, the lower portion of the pump actuator being attached to the upper portion of the pump actuator so that the lower portion is rotatable toward the upper portion to a storage position.

The container may be formed of a material which permits the level of material within the container to be viewed. A variety of translucent or transparent materials may be utilized, such as, for example, natural polyethylene and the like.

DETAILED DESCRIPTION

Figure 1:
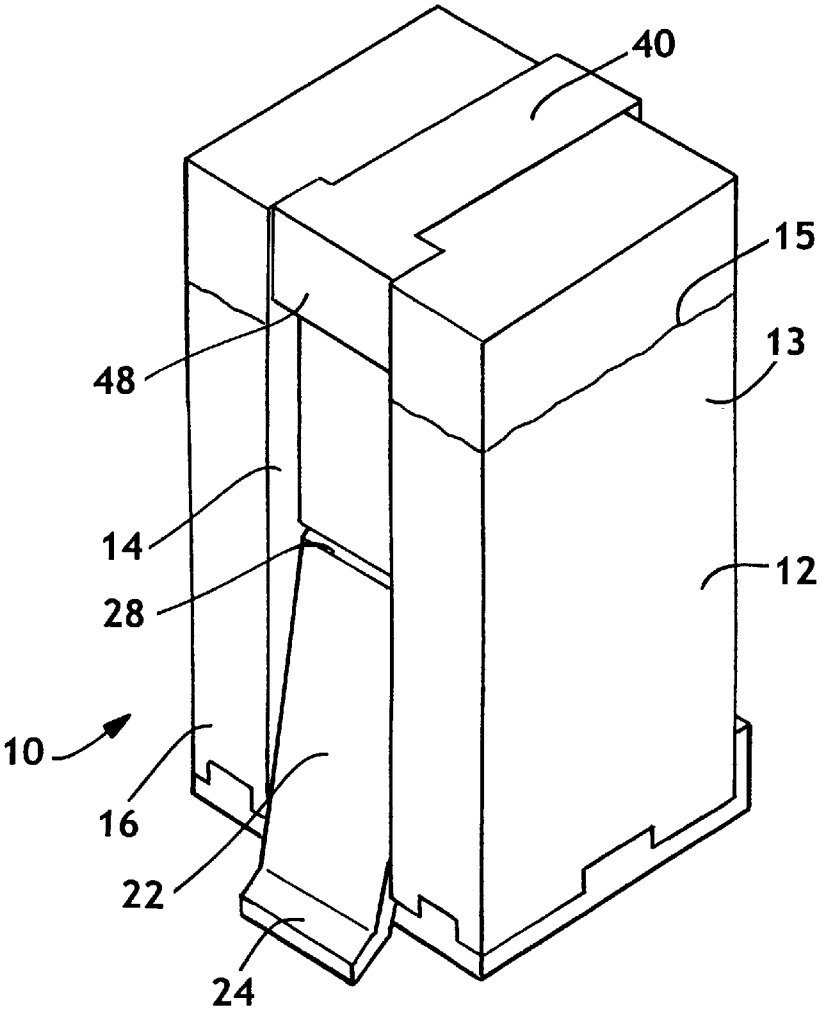
FIG. 1 is a perspective view of an embodiment of the dispensing system of the present invention.
Figure 3:
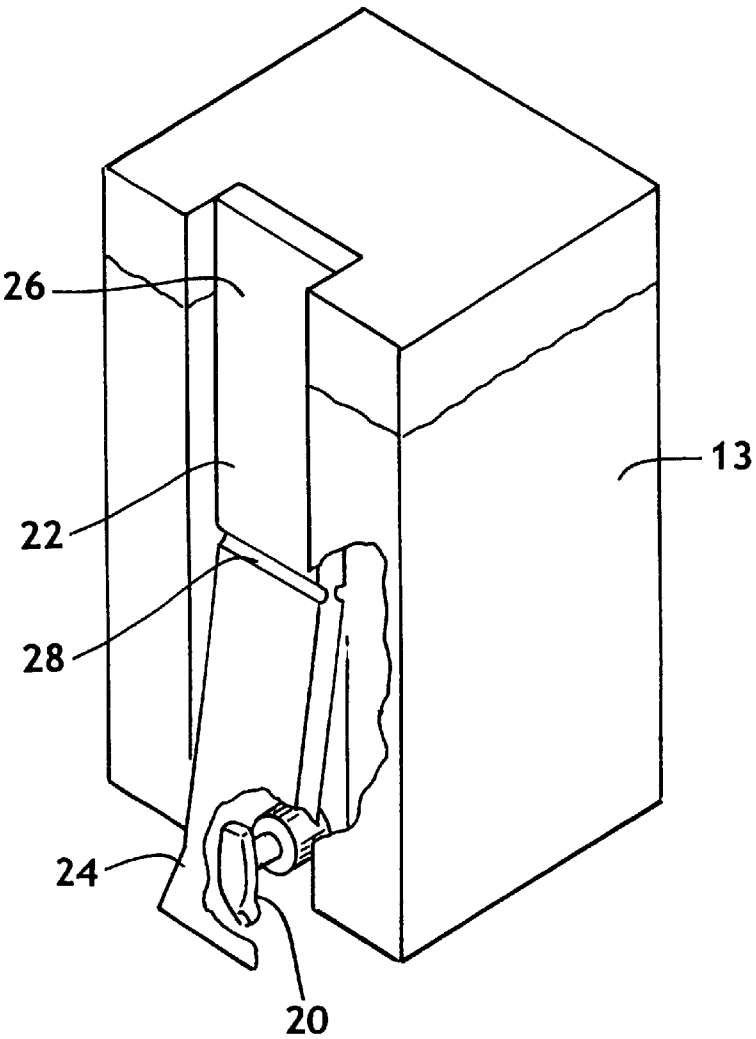
FIG. 3 is a perspective view of an alternate embodiment of the container, pump assembly and pump actuator of the present invention, the pump assembly and pump actuator being shown in their dispensing position.

The present invention is directed to a dispensing system, an embodiment of such a system being shown in FIG. 1 at 10. The dispensing system 10 includes a container 12 adapted to hold a flowable material 13 such as, for example, soap, lotion and the like. As shown in FIGS. 1 and 3, a large portion of the container is visible to the user, clearly showing the amount of material remaining in the container 12.

The container 12 may be formed by a variety of processes, such as, for example, blow molding, injection molding and the like. The container may be variously shaped, such as a box, a sphere or other geometric shape.

Figure 2:
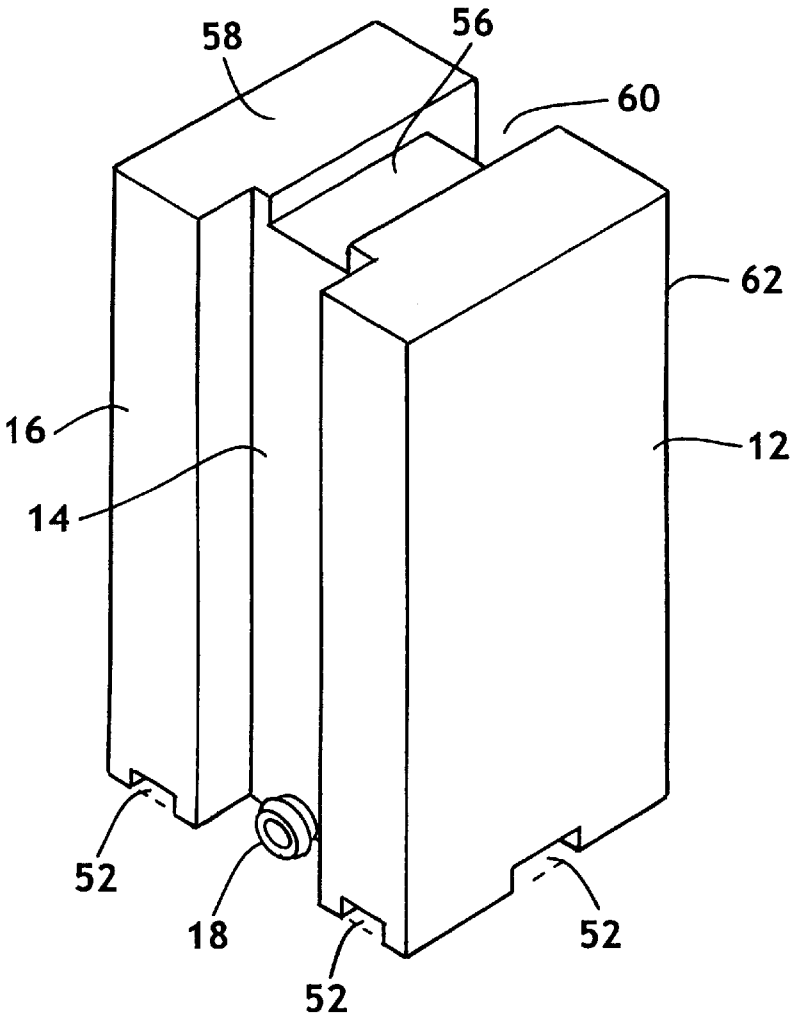
FIG. 2 is a perspective view of an embodiment of the container according to the present invention.

As shown in FIG. 2, the container 12 includes a first recess 14 positioned along an outer surface 16 of the container 12. In selected embodiments, the first recess 14 and outer surface 16 are positioned facing a user.

As best shown in FIGS. 2, 3 and 5–7, the container 12 includes a passageway 18 extending into the container 12. The passageway 18 is positioned within the first recess 14 of the container 12. The passageway 18 is configured to receive a pump assembly 20, as shown in FIGS. 4–7. The pump assembly 20 may be a commercially available or custom pumping means, such as, for example, a piston, bellows or other suitable pump such as a flexible tube-type peristaltic pump. The pump assembly 20 may engage the passageway 18 in a variety of ways, such as, for example, a snap-type engagement, or threaded engagement. The pump assembly 20 may be permanently attached to the container 12 or removably attached to the container 12.

Figure 5:
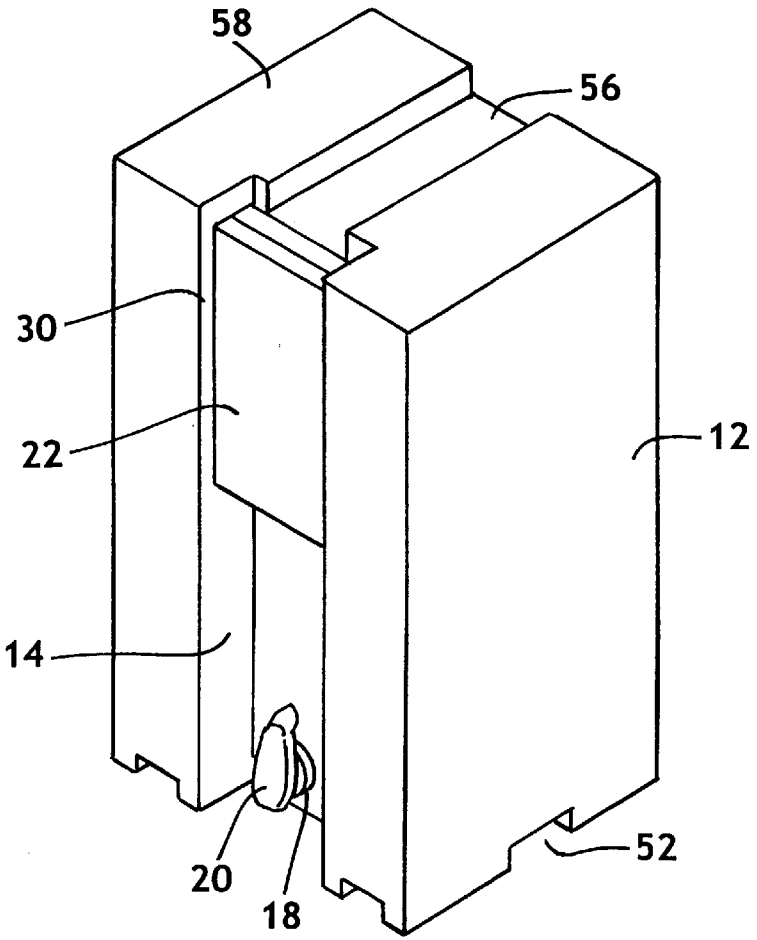
FIG. 5 is a perspective view of another alternate embodiment of the container, pump assembly and pump actuator according to the present invention the pump assembly and pump actuator being shown in their storage positions.
Figure 7:
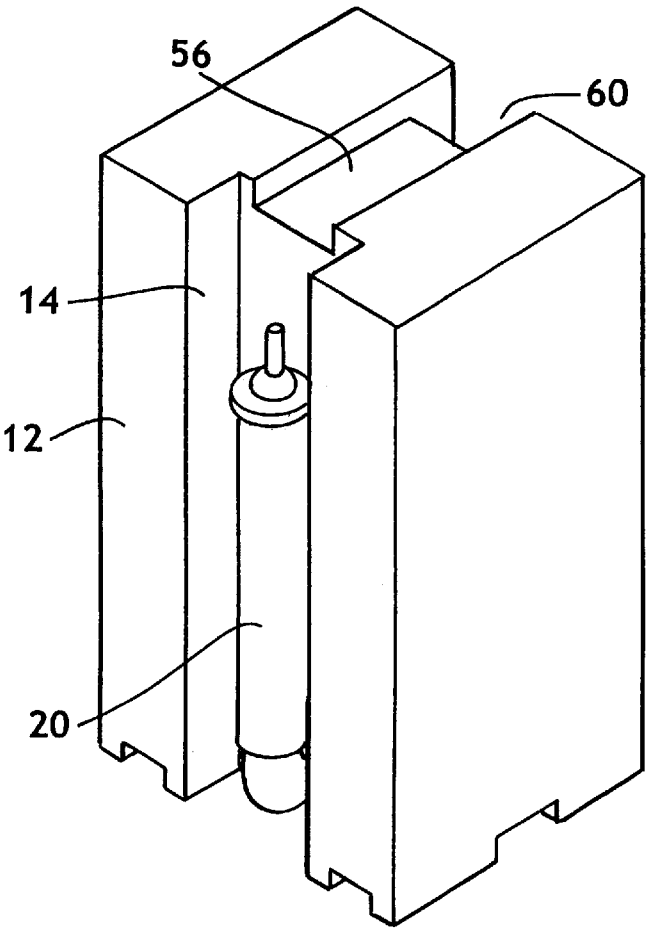
FIG. 7 is a perspective view of the embodiment of the container and pump assembly depicted in FIG. 6, the pump assembly being shown in its storage position.
Figure 6:
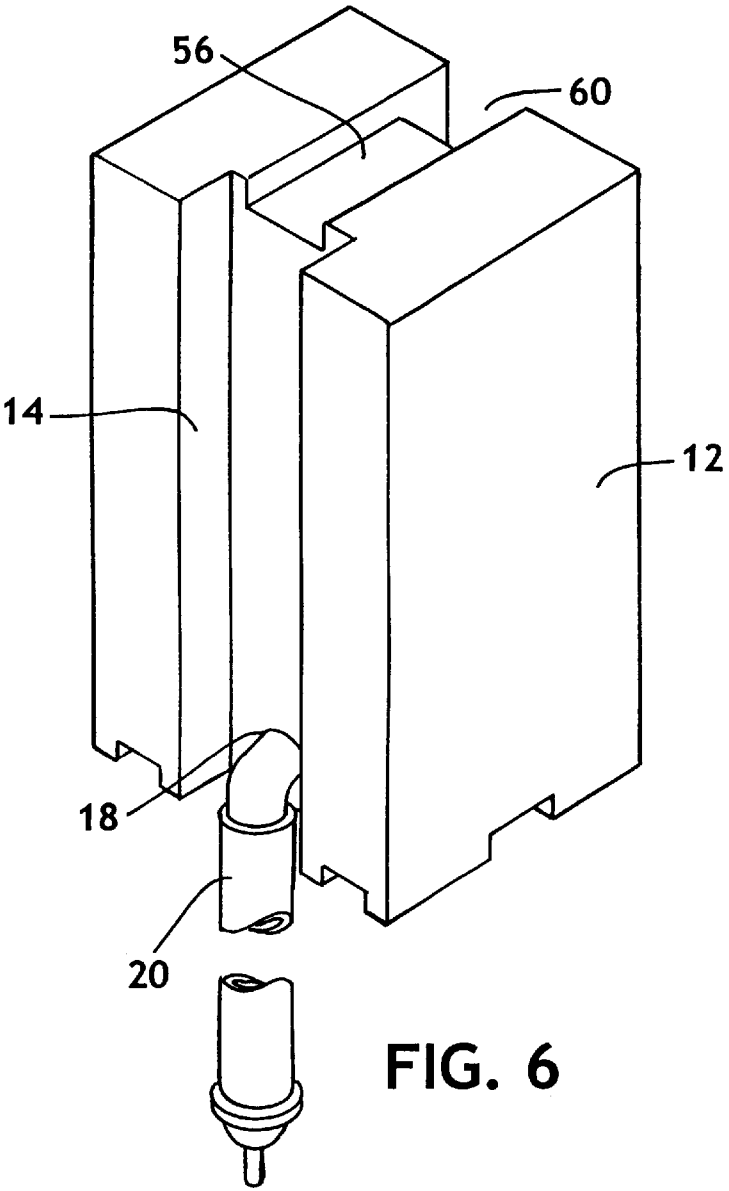
FIG. 6 is a perspective view of still another alternate embodiment of the container and pump assembly according to the present invention, the pump assembly being shown therein in its dispensing position.

As shown in FIG. 3, a pump assembly 20 has been engaged to the passageway 18. The portion of the pump assembly extending exteriorly of the container 12 is in a dispensing position, allowing material within the container to be dispensed to a user. As shown in FIG. 5, the portion of the pump assembly 20 extending exteriorly of the container 12 has been moved to a storage position by rotating it 180 degrees so that it is contained within the first recess 14. In other embodiments, the pump assembly 20 extending exteriorly of the container 12 may be rotated less than 180 degrees or more than 180 degrees to reach its storage position. The portion of the pump assembly when the pump assembly 20 is in its storage position, the container may be stored and transported without damage to the pump assembly. Additionally, the storage and shipment of such containers will take up less space and thereby be more economical. Similarly, FIGS. 6 and 7 depict a flexible tube-type pump currently available. The pump is attached to a rotatable fitting, permitting the pump to be rotated to its storage position.

Referring now to FIGS. 1 and 3, a pump actuator 22 is shown therein. A user may apply pressure to the pump actuator 22 causing the pump actuator 22 to actuate the pump assembly 20 and dispense material from the container. Although the pump actuator may be variously configured to achieve this purpose, in selected embodiments, the pump actuator 22 includes a lower portion 24 and an upper portion 26. The lower portion 24 of the pump actuator 22 may be attached to the upper portion 26 so that the lower portion 24 is rotatable toward the upper portion to a storage position. As shown in FIGS. 1 and 3, a living hinge is utilized. Other configurations of the lower and upper portions may be utilized and affixed to each other in a variety of manners.

Although not shown, a locking mechanism may be provided to lock the lower portion 24 in its storage position. Such mechanisms may be removed once the pump actuator 22 is in its actuating position, and may include, for example, hook and loop fasteners such as VELCRO® or adhesives. In alternate embodiments, the container 12 and/or pump actuator 22 may be configured to lock the lower portion 24 in its storage position. For example, as shown in FIG. 5, a ridge 30 may be provided within the first recess 14. In such an embodiment, the lower portion 24 may be snapped past the ridge 30 to its storage position. To move the lower portion 24 of the pump actuator to its actuating position, the lower portion 24 may be snapped out of the first recess 14 past the ridge 30. In yet other embodiments, the first recess 14 may increase in width as it nears the passageway 18 so that, while the lower portion 24 may swing freely in its actuating position, the lower portion 24 may fit snugly into the first recess 14 in its storage position.

Figure 4:
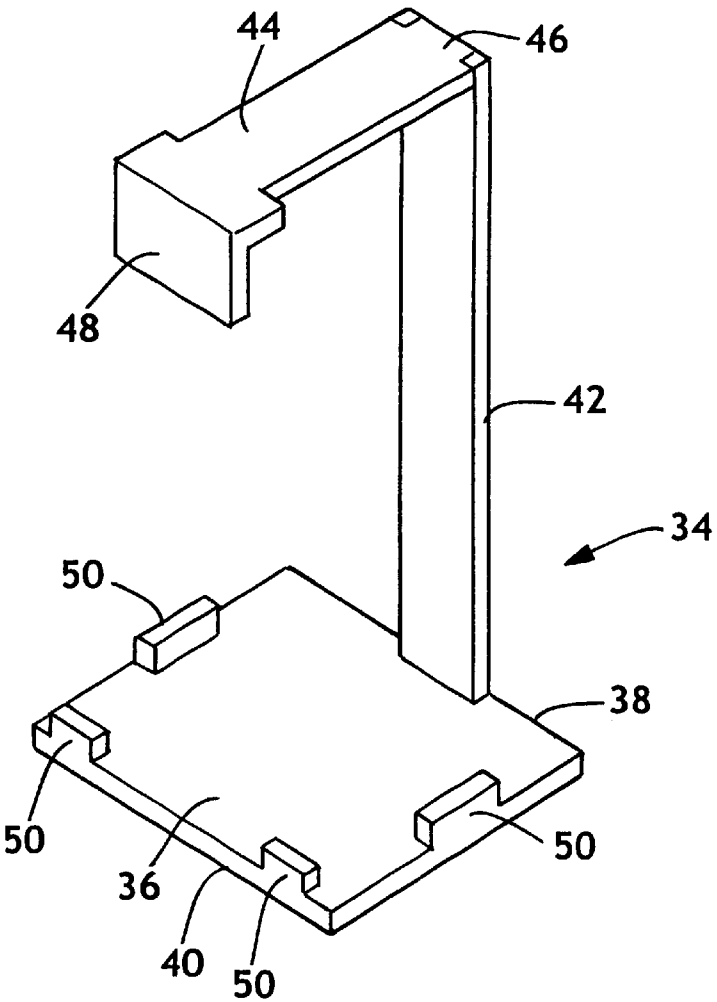
FIG. 4 is a perspective view of an embodiment of the mounting bracket according to the present invention.

The container 12 and the pump assembly 20 may be utilized as a stand-alone dispensing system where the container 12 may rest on a surface such as a countertop or shelf. In certain applications, it will be desirable to secure the container 12 to the surface or a wall. In such instances, a mounting bracket 34 as shown in FIG. 4 may be utilized with the container 12. The mounting bracket 34 may be configured to support the container 12 and inhibit relative movement between the container 12 and the mounting bracket 34. A wide variety of mounting brackets may be utilized. In the embodiment depicted in FIG. 4, the mounting bracket 34 includes a base 36 having a back edge 38 and a front edge 40. A column 42 extends upwardly from the base 34 proximate to the back edge 38. The column 42 may be attached to a wall or other surface in a variety of ways, including, for example, by adhesive, mechanical fasteners, and the like.

An upper member 40 is pivotably mounted at its first end 46 to the column 42. The upper member 40 may be L-shaped as depicted in FIG. 4. The second end 48 of the upper member 44 may be pivoted upwardly and away from the base 36 to permit placement of the container 12 within the bracket 34. After the container 12 is placed on the base 36, the upper member 40 may be pivoted downwardly to lock the container 12 in a fixed position on the base 36. The second end 48 may further include a locking mechanism such as a locking ridge (not shown) which may engage a locking feature on the container 12 or pump actuator 22. This would enable the container 12 to be locked to the base 38.

Additionally, the base 38 and/or container 12 may include detents and bosses which interlock to further secure the container 12 to the base 38. In the embodiment depicted in FIGS. 1 and 4, four bosses 50 are positioned on and extend upwardly from the base 36. The bosses 50 may be arranged so that the container 12 is prevented from sliding in any direction. As depicted in FIGS. 1 and 5, detents 52 are provided on the container 12. When the container 12 is placed within the mounting bracket 34, the bosses 50 engage the detents 52, thus preventing the container 12 from sliding relative to the mounting bracket 34. The placement of the bosses and detents may vary widely and still perform their intended function. Additionally, it is apparent that the bosses 50 may be formed on the container 12 and/or the mounting bracket 34, and the detents 52 may be formed in the mounting bracket 34 and/or the container 12.

As clearly shown in FIG. 5, the container 12 may further include a second recess 56 positioned on an upper surface 58 of the container 12. As shown in FIG. 1, the second recess 56 may be configured so that the upper member 40 may be positioned within the second recess 56. Additionally, a third recess 60 may be positioned on the back surface 62 of the container 12. The column 42 may be configured to fit within the third recess 60. By recessing the mounting bracket 34 into the container 12, the dispensing system 10 has a more streamlined look and is potentially more stable than dispensing systems wherein brackets merely wrap around a container.

The embodiment depicted in FIG. 6 includes a peristaltic pump which rotatably engages the opening 18 so that, during use, the pump 20 rotated downward into a dispensing position so that a user may actuate the pump and dispense material 13 from the container 12. As shown in FIG. 7, the pump 20 may be rotated upwardly into a storage position, the pump 20 being disposed within the first recess 14 of the housing 12.

The embodiment of the container 12 depicted in FIGS. 6 and 7 includes a is first recess 14, a second recess 56 and a third recess 60 into which a bracket 34 may be placed so as to minimize the space occupied by the dispensing system 10 during shipment or storage.

To enable a user to clearly see the amount of material 13 remaining in the container 12, the container 12 may be formed from a transparent or translucent material such as, for example, natural polyethylene.

Figure 8:
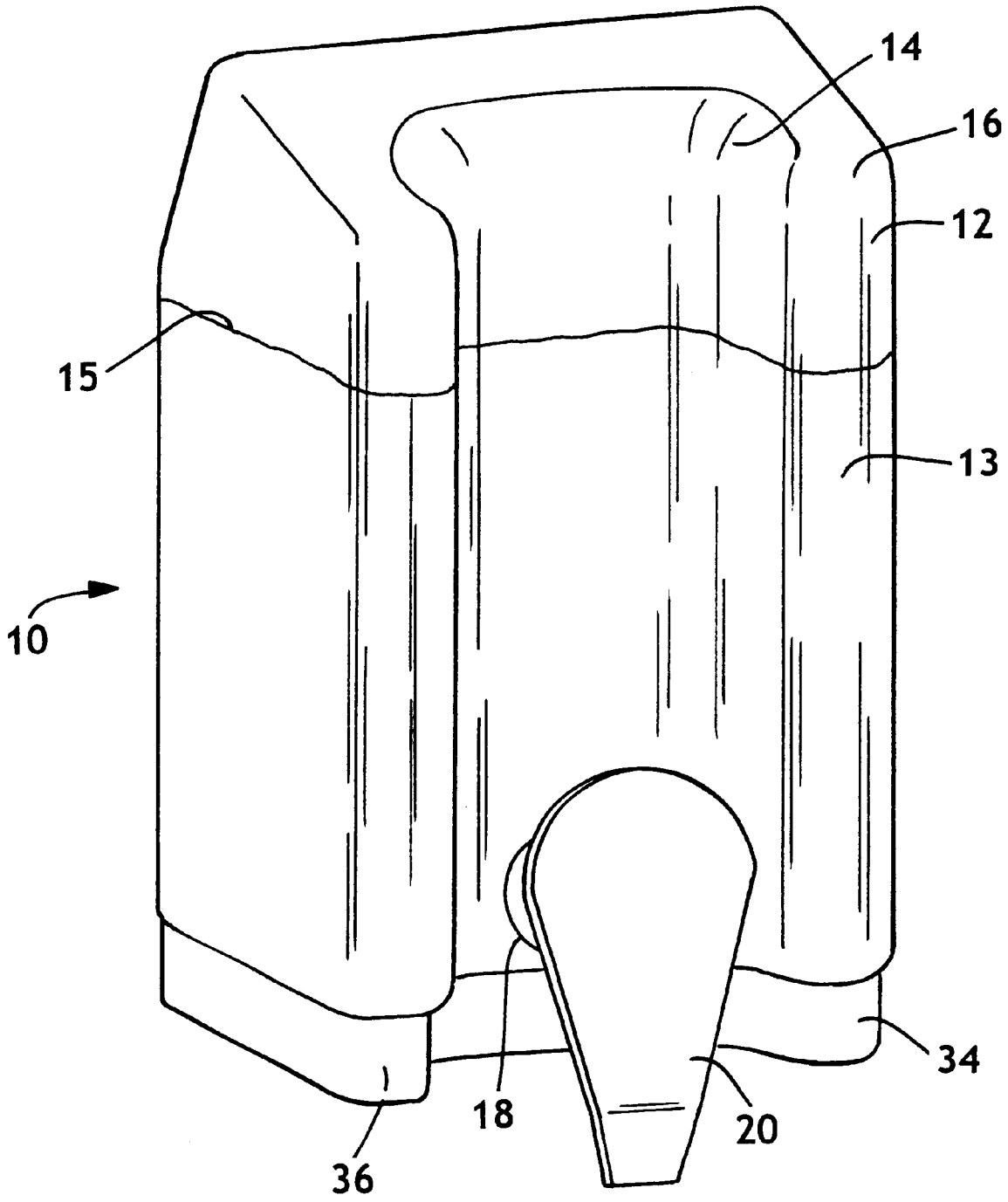
FIG. 8 is a perspective view of an alternate embodiment of the dispensing system of the present invention, the system including a container, mounting bracket and pump assembly.

The dispensing system depicted in FIG. 8 at 10 includes a container 12 in which a material 13 is contained. In selected embodiments, the container 12 is made of a material through which the level of material 13 within the container can be seen from exteriorly of the container 12. The container 12 may be translucent or transparent, and includes a recess 14. Disposed within the recess 14 is a passageway 18 through which a pump assembly 20 is inserted. As shown in FIG. 8, the front portion of the pump assembly 20 extends below the base 36 of the bracket 34. The front portion of the pump assembly 20 is rotatable with respect to the container 12 so that the front portion of the pump assembly 20 may be rotated upwardly to a storage position. This enables the front portion of the pump assembly to be positioned within the recess 14, thus minimizing the amount of space required to ship and store the dispensing system 10.

The container 12 may be variously shaped within the scope of the present invention. For example, the container 12 depicted in FIG. 8 includes a back surface 62, the upper portion of which is angled with respect to the lower portion.

Figure 9:
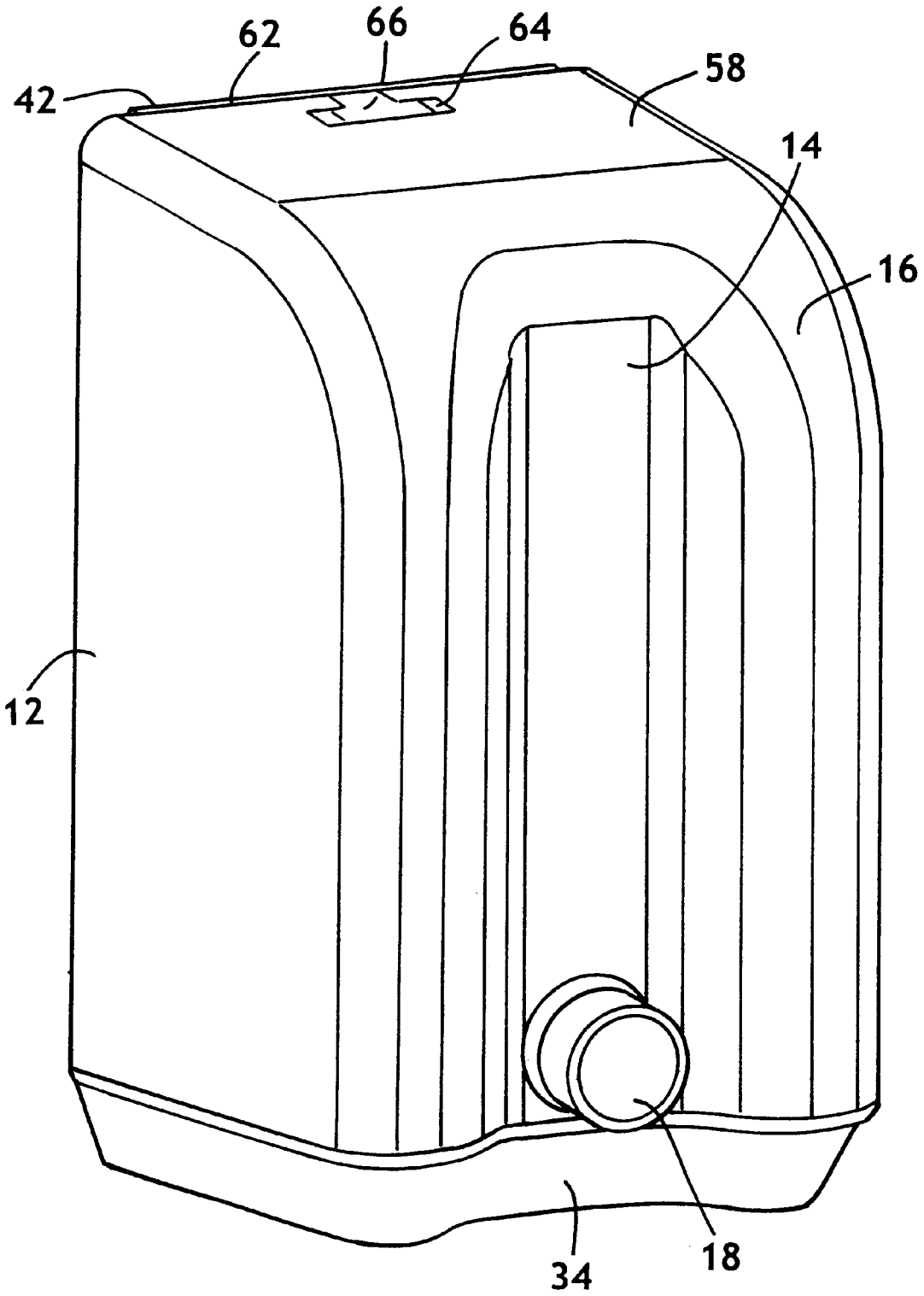
FIG. 9 is a perspective view of an alternate embodiment of the dispensing system of the present invention, the system including a container and a mounting bracket.
Figure 10:
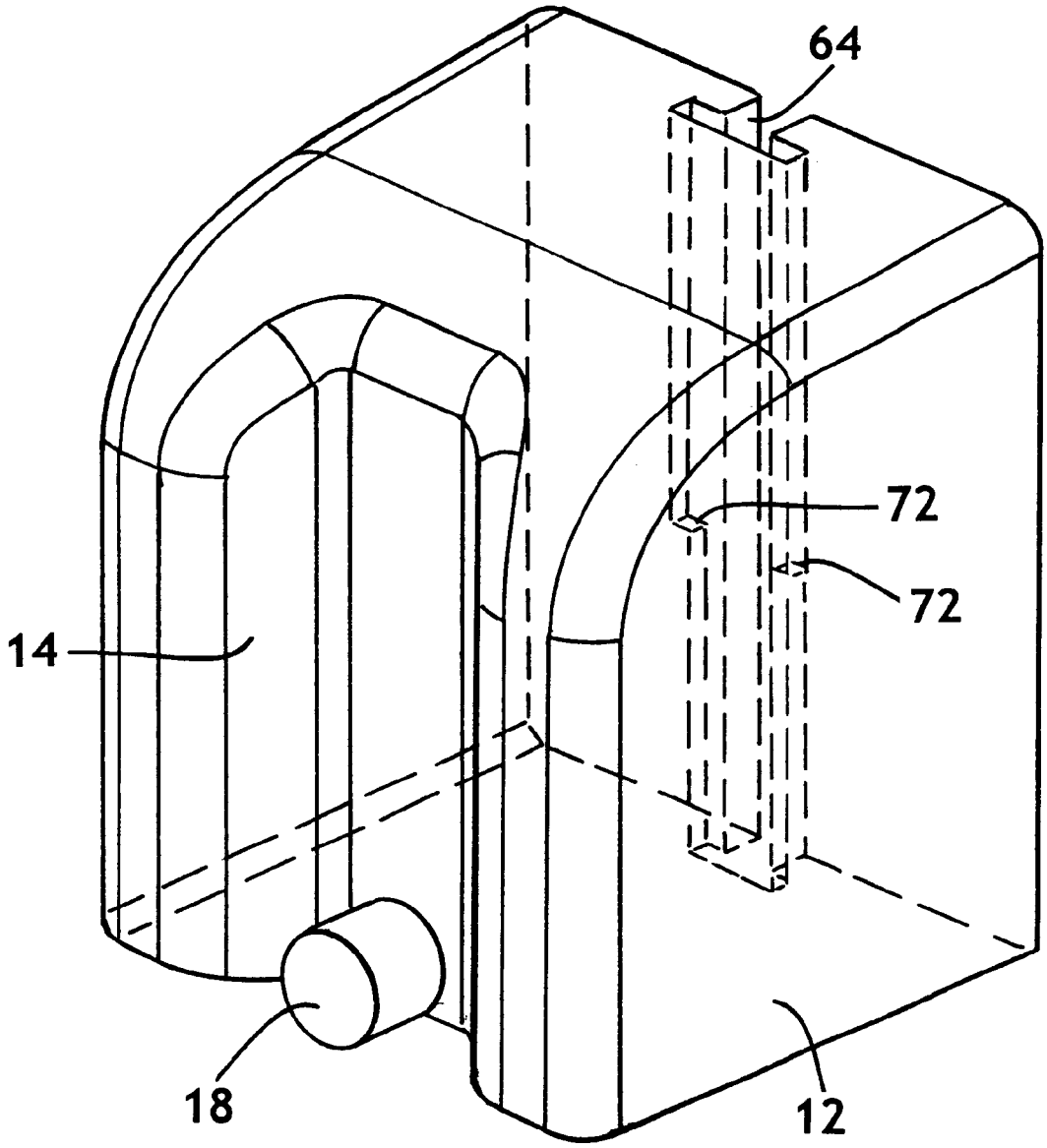
FIG. 10 is a perspective schematic of a container according to the present invention.
Figure 18:
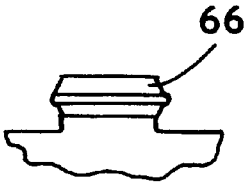
FIG. 18 is a top view of an alternate embodiment of a protrusion according to the present invention.
Figure 17:
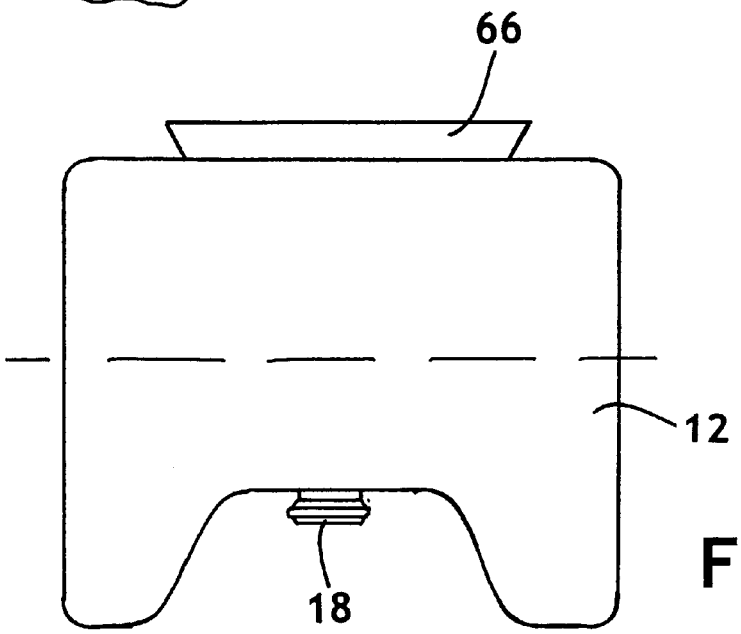
FIG. 17 is a top view of yet another alternate embodiment of the container according to the present invention.
Figure 19:
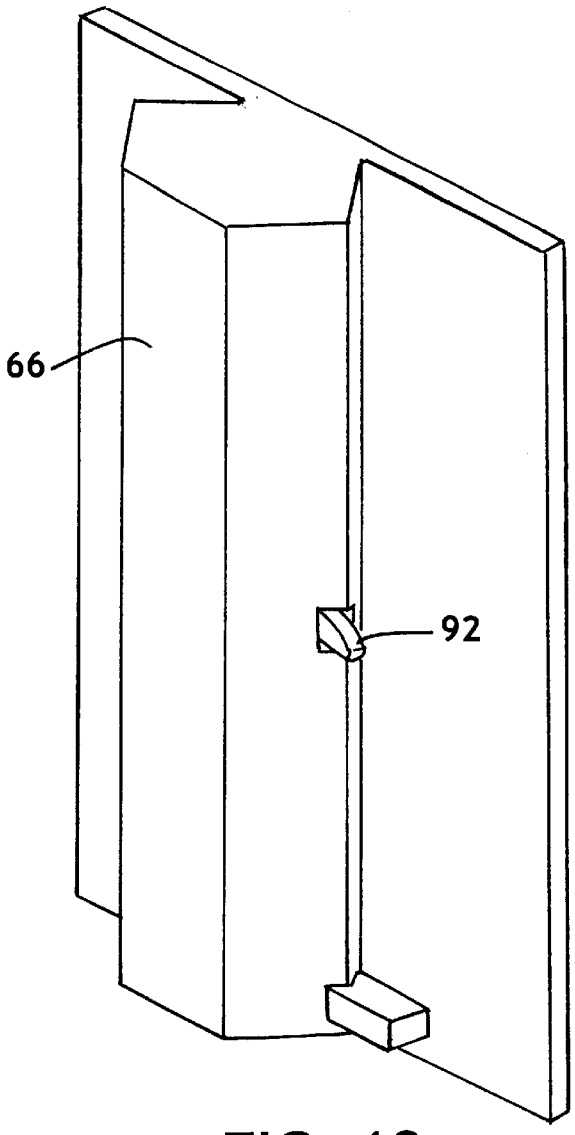
FIG. 19 is a perspective view of another alternate embodiment of a protrusion according to the present invention.

The embodiment of the present invention depicted in FIG. 9 includes a container 12 and mounting bracket 34. The container 12 includes an indentation or slot 64 which is formed in the back surface 62 of the container 12. In the embodiment shown in FIG. 9, the slot extends upwardly through the upper surface 58 of the container 12. As best shown in FIG. 10, the indentation or slot 64 may be T-shaped and may further include a pair of lock shoulders 72, each lock shoulder 72 disposed on opposite sides of the indentation or slot 64. As shown therein, the indentation or slot 64 extends through lower portion of the container 12. The bracket 34 depicted in FIG. 11 includes a protrusion or key 66 which engages the indentation or slot 64. In the embodiment shown in FIG. 11, the protrusion or key 66 extends the length of the column 42, although the protrusion or key 66 may extend along only a portion of the column 42 in other embodiments. Alternate configurations of the indentation and protrusion may be utilized, so long as the indentation is configured to mate with the protrusion. Alternate configurations of the protrusion or key 66 are depicted in FIGS. 17–19, although many other configurations may be utilized with the present invention.

Figure 11:
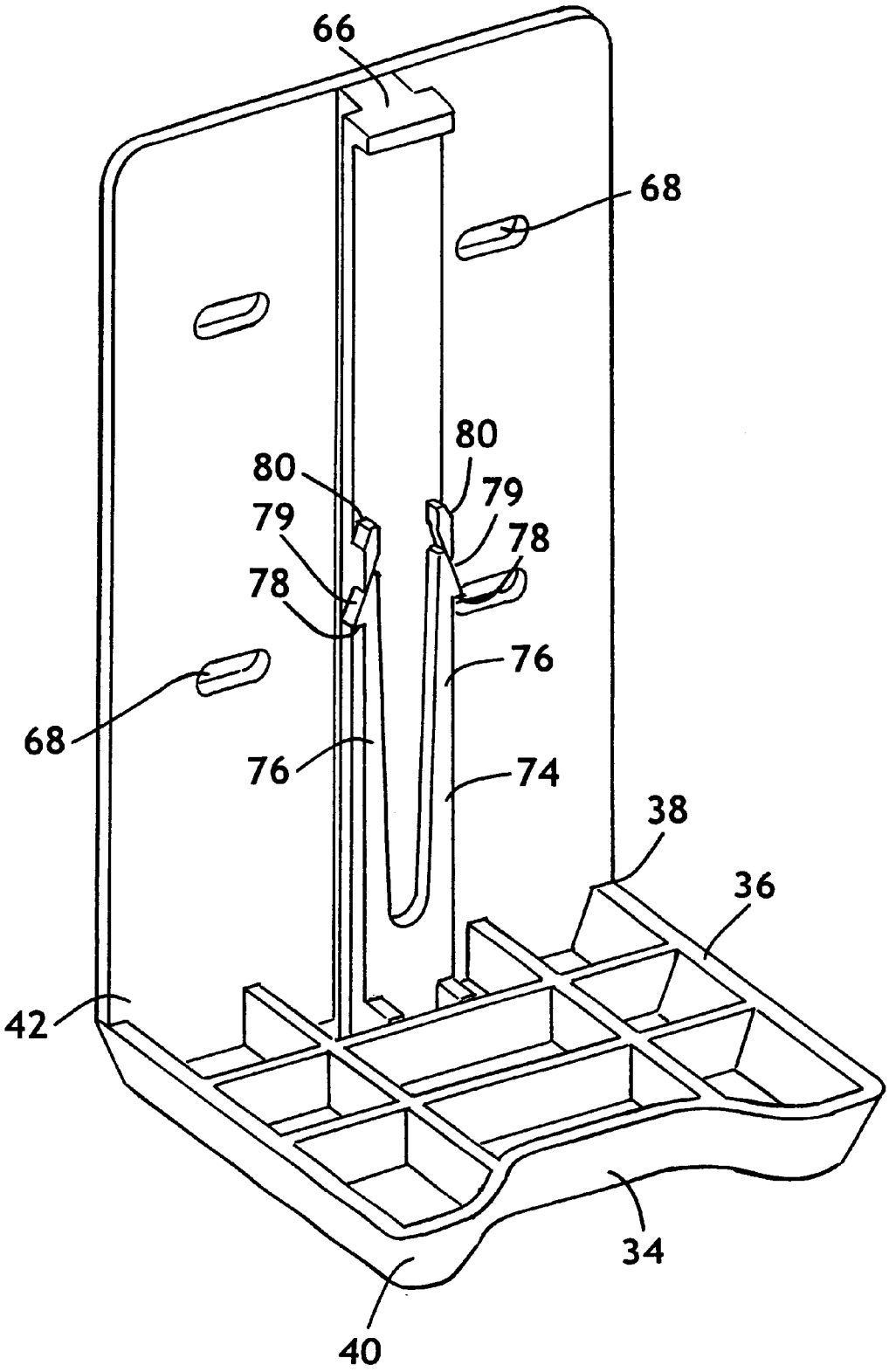
FIG. 11 is a perspective view of an embodiment of the bracket according to the present invention.
Figure 12:
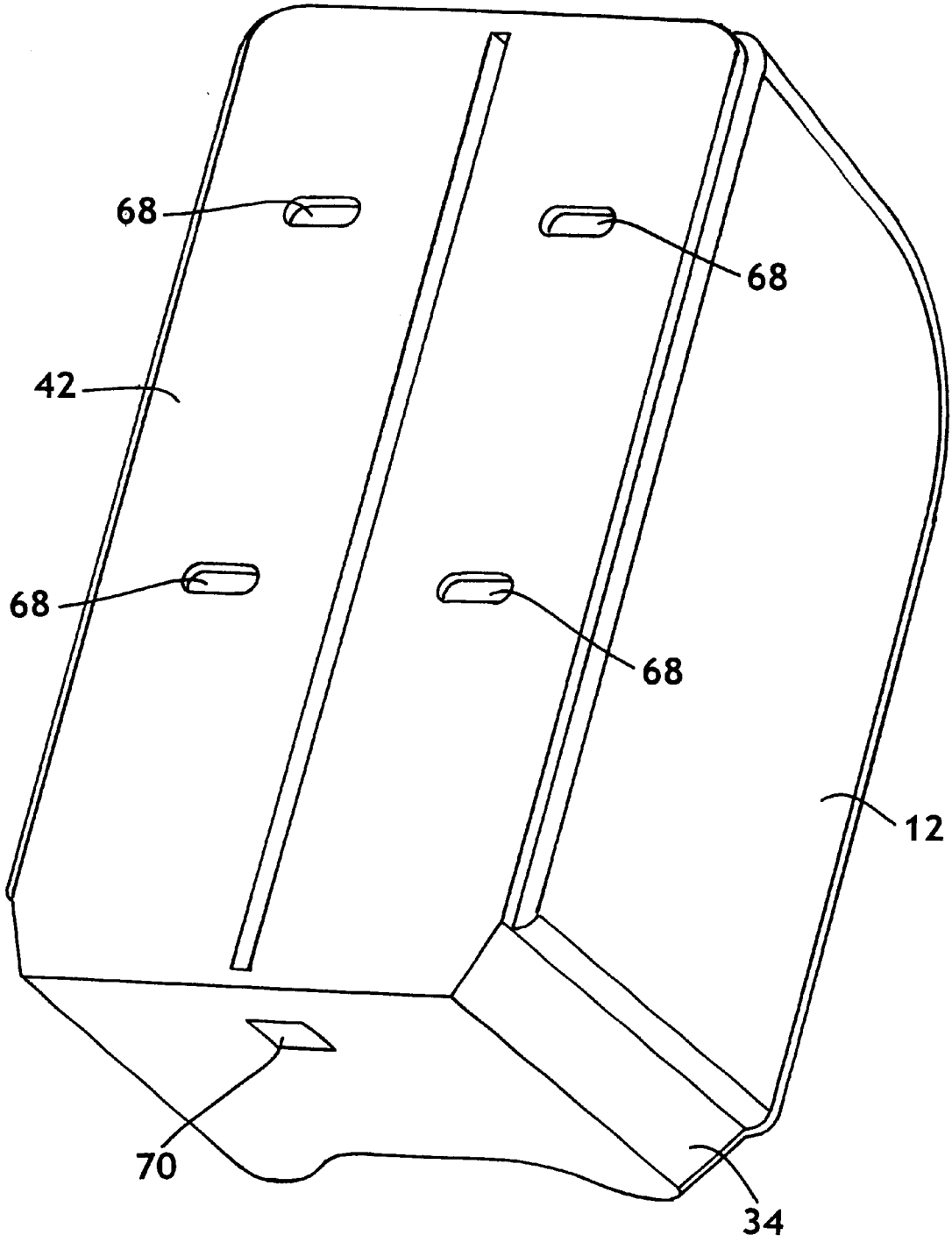
FIG. 12 is a perspective rear view of the embodiment depicted in FIG. 9.

Also shown in FIG. 11 is a lock 74 which includes two lock arms 76 extending upwardly from the base of the lock 74. Each lock arm includes an undercut 78. The rear surface of the lock 74 is positioned against the protrusion or key 66 and the base of the lock 74 is positioned against the base 36 of the mounting bracket 34. The upper surfaces 79 of the lock arms 76 are positioned against release members 80 which extend outwardly from the protrusion or key 66. As shown in FIG. 12, an opening 70 is formed in the base 36 of the bracket 34, the opening being positioned beneath the lock 72 so that a user may reach into opening 70 and push the lock 72 upward away from the base 36. In doing so, the upper surfaces 79 are forced against release members 80, causing the lock arms 76 to flex inwardly.

As the mounting bracket 34 is engaged to the container 12, the protrusion or key 66 engages the indentation or slot 64. As the protrusion or key 66 moves further into the slot or indentation 64, the lock arms 76 encounter the sides of the slot or indentation 64, causing the lock arms 76 flex inwardly. When the mounting bracket 34 is sufficiently engaged to the container 12 to move the lock arms past the shoulders 72 of the slot or indentation 64, the lock arms 76 flex outwardly and the undercut portions 78 of the lock arms 76 engage the shoulders 72. In this manner, the bracket 34 is locked to the container 12.

To release the container 12 from the bracket, a user reaches through the opening 70 in the base 36 of the bracket 34 and pushes the lock 74 upwardly. As the lock 74 is moved upwardly, the upper surfaces 79 of the lock arms 76 engage the release members 80, causing the lock arms 76 to flex inwardly. As the lock arms 76 flex inwardly, the undercut portion 78 of each lock arm 76 is moved away from the lock shoulders 72 of the indentation or slot 66.

Figure 13:
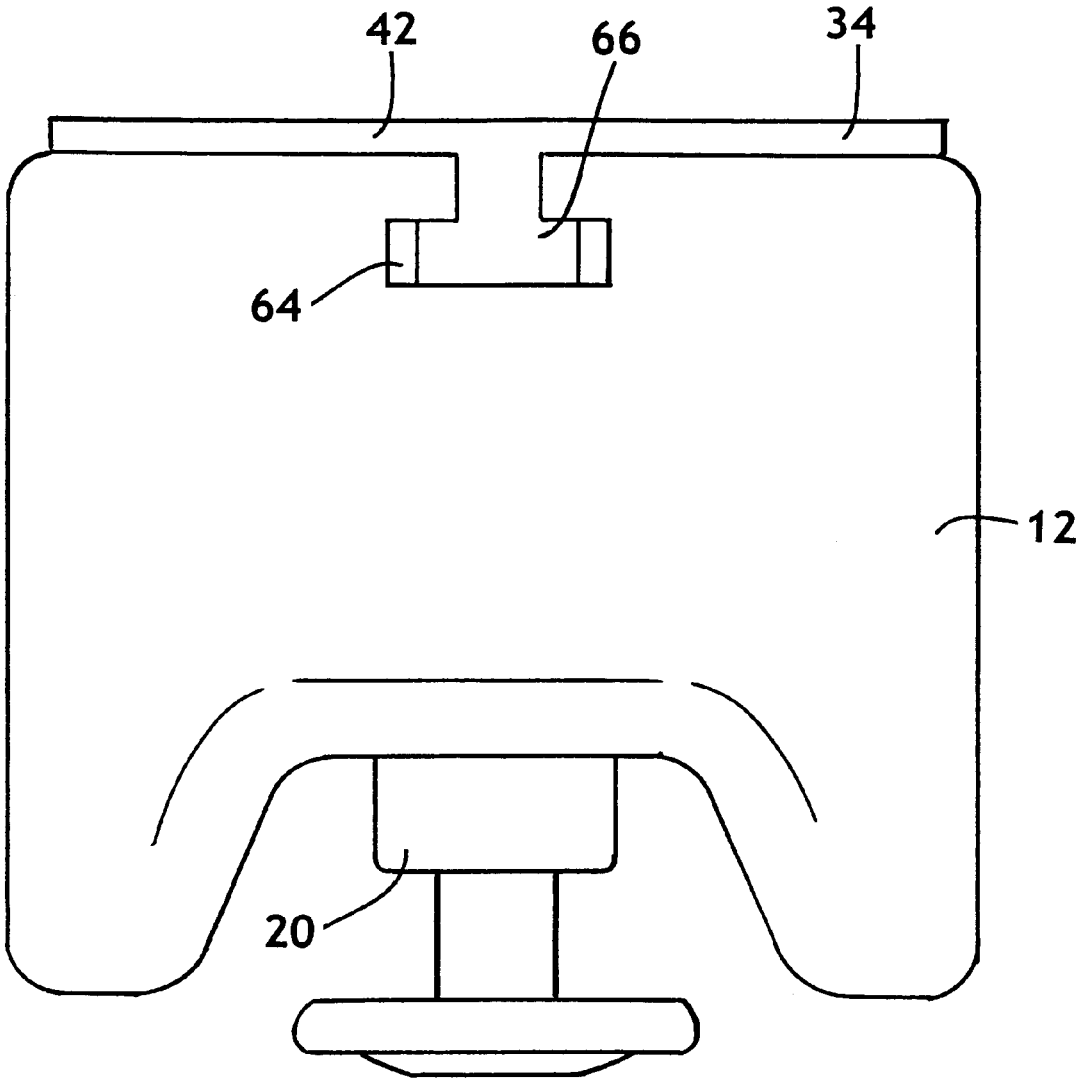
FIG. 13 is a top view of the embodiment of the dispensing system depicted in FIGS. 9–12.

A top view of the container 12 and bracket 34 described above are shown in FIG. 13.

In alternate embodiments, the slot or indentation 66 may be disposed on the bracket 34 and the key or protrusion 66 may be disposed on the container 12. Additionally, alternate configurations of the bracket 34 and container 12 may be utilized to enable the bracket and container to be locked together.

As shown in FIGS. 11 and 12, the bracket 34 may include mounting holes 68. Mechanical fasteners such as screws, bolts, nails and the like may be utilized to secure the bracket, through the mounting holes 68, to a surface. Additionally, the holes 68 may be configured to engage mounting features which are already present on the surface to which the bracket is to be secured. The bracket 43 may also be mounted to a surface by adhesive such as two-sided tape and the like.

Figure 14:
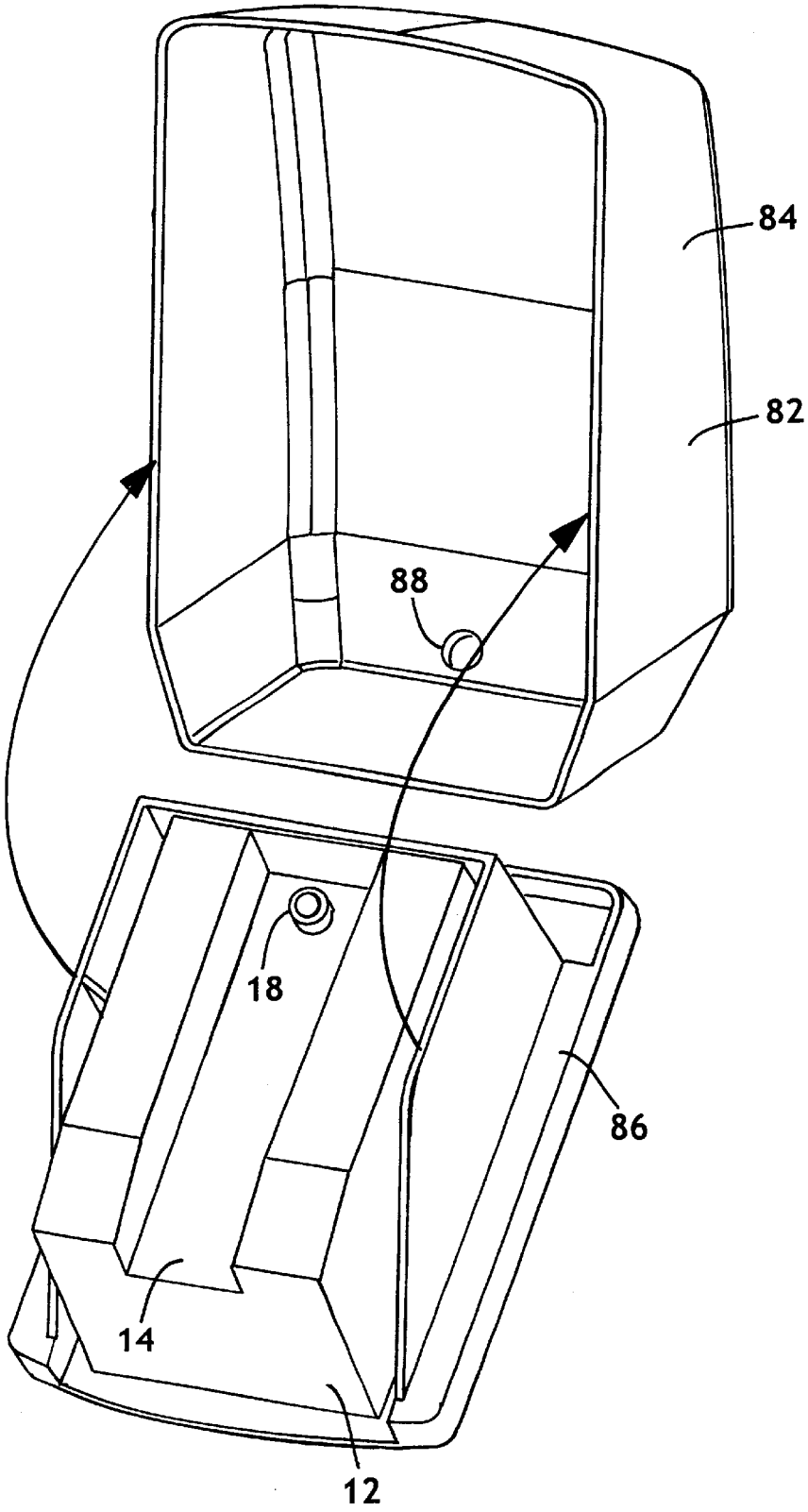
FIG. 14 is a perspective exploded view of the container of the present invention being utilized within a conventional dispenser as a refill.

As shown in FIG. 14, the container 12 of the present invention may be utilized within a conventional dispenser 82 having a front cover 84 and back cover 86. The passageway 18 may be positioned on the container 12 so that passageway 18 may be aligned with the opening 88 positioned in the front cover 84 of the conventional dispenser 82. Additionally, the pump assembly 20 may be utilized with the container shown in FIG. 14 so that the pump assembly 20 may extend through the opening 88 in the front cover 84 through the passageway 18 and into the container 12.

Figure 20:
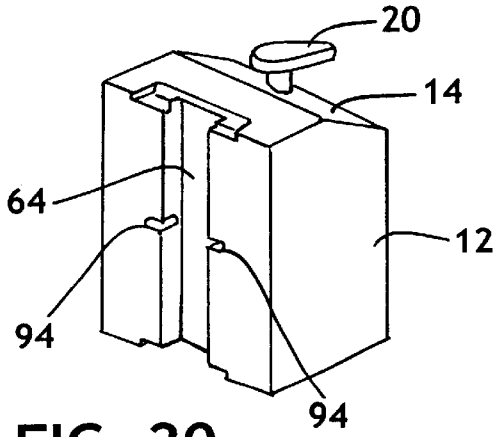
FIG. 20 is a perspective view of still another embodiment of the container and pump assembly according to the present invention.

An alternate configuration of the slot and indentation are shown in FIGS. 19 and 20. An additional locking member 92 extends outwardly from each side of the protrusion 66 (only one shown). Each locking member 92 engages a cutout 94 in the slot 64.

Figure 15:
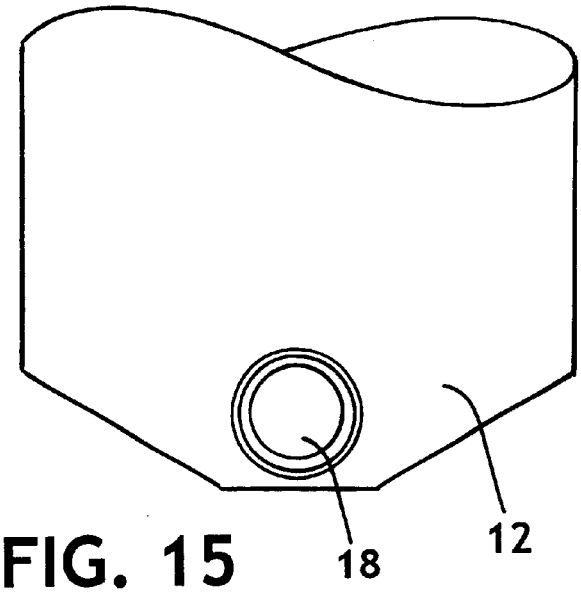
FIG. 15 is a front view of an alternate embodiment of the container according to the present invention.
Figure 16:
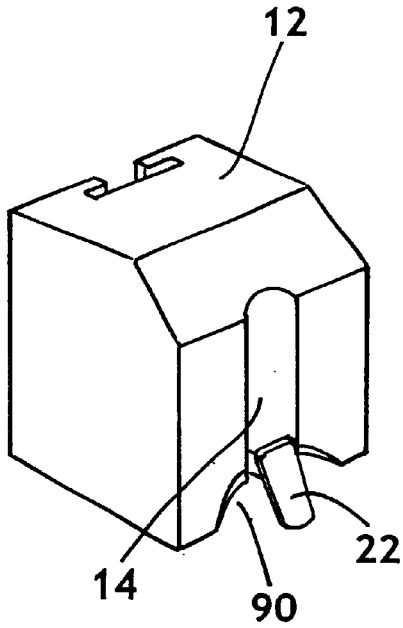
FIG. 16 is a perspective view of another alternate embodiment of the container and pump assembly according to the present invention.

An alternate embodiment of the container is partially depicted in FIG. 15, the lower surface of the container 12 being roughly V-shaped. Another alternate embodiment of the container 12 is depicted in FIG. 16 where the lower surface of the container 12 includes an arch in the vicinity of the passageway 18 and pump actuator 22.

Still another embodiment of the present invention is depicted in FIG. 20, the recess 14 extending across the front of the container 12. The passageway 18 and pump assembly 20 are positioned in the recess 14.

The dispensing system of the present invention additionally permits the use of a wide variety of graphics which may be applied to the container 12. The graphics may convey information to the user such as, for example, the type and source of the material 13 within the container 12. The use of graphics with previous dispensing systems was difficult, as the graphics were applied to the dispenser cover. In the present invention, the graphics may be applied to the container 12. This permits the graphics to be easily changed by simply removing an empty container 12 and installing a full container 12 to which different graphics have been or may be applied.

I claim:

1. A fluid dispensing system comprising:

a container adapted to hold a material, the container having a first recess positioned on an outer surface of the container, a passageway extending into the container, the passageway positioned within the recess of the container;

a pump assembly adapted to engage the passageway of the container, the pump assembly having a storage position wherein the pump assembly is disposed substantially within the recess, the pump assembly adapted to dispense fluid from the container; and a mounting bracket adapted to support the container, the mounting bracket having a base;

a column extending upwardly from the base; and an upper member pivotably mounted to the column.

2. The dispensing system of claim 1 further including at least one boss and detent, the boss positioned on the mounting bracket, the detent positioned on the container, the boss engaging the detent upon placement of the container within the mounting bracket, the boss are detent adapted to inhibit relative movement between the mounting bracket and container.

3. The fluid dispensing system of claim 1 further including a pump actuator having an upper portion flexibly attached to a lower portion, the lower portion operable to actuate the pump assembly and dispense fluid from the container.

4. The dispensing system of claim 1, the lower portion of the pump actuator being attached to the upper portion of the pump actuator so that the lower portion is rotatable toward the upper portion to a storage position.

5. A dispensing system comprising:

a container having a recess positioned on an outer surface of the container;

a passageway extending into the container, the passageway positioned within the recess of the container;

a pump assembly adapted to engage the passageway, the pump assembly having a storage position wherein the pump assembly is substantially disposed within the recess;

a pump actuator operable to actuate the pump assembly and dispense material from the container, the pump actuator further including a lower portion and an upper portion, the lower portion of the pump actuator being attached to the upper portion of the pump actuator so that the lower portion is rotatable toward the upper portion to a storage position.

6. The dispensing system of claim 5 further including a mounting bracket adapted to support the container.

7. The dispensing system of claim 6 wherein the mounting bracket further includes a base and a column extending upwardly from the base.

8. The dispensing system of claim 7 wherein the mounting bracket further includes an upper member pivotably mounted to the column.

9. The dispensing system of claim 6, the mounting bracket engaging the container through a slot-and-key configuration, the slot positionable on either the mounting bracket or the container.

10. The dispensing system of claim 6 further including at least one boss and detent, the boss engaging the detent upon placement of the container within the mounting bracket, the boss and detent adapted to inhibit relative movement between the mounting bracket and container.

11. The dispensing system of claim 6 further including a locking mechanism adapted to lock the container to the mounting bracket.

* * * * *